US006742662B1

(12) United States Patent
McCormick et al.

(10) Patent No.: US 6,742,662 B1
(45) Date of Patent: Jun. 1, 2004

(54) BILLIARD BALL RACK

(75) Inventors: William R. McCormick, Kenosha, WI (US); Kelly M. Wolcott, Kenosha, WI (US); Theodore J. Caron, Kenosha, WI (US)

(73) Assignee: Brunswick Bowling & Billiards Corporation, Muskegon, MI (US)

( * ) Notice: Subject to any disclaimer, the term of this patent is extended or adjusted under 35 U.S.C. 154(b) by 56 days.

(21) Appl. No.: 09/699,603

(22) Filed: Oct. 30, 2000

(51) Int. Cl.[7] ..... A47F 7/00

(52) U.S. Cl. ..... 211/14; 211/15; 211/68; D6/552

(58) Field of Search ..... 211/14, 15, 68, 211/59.2; D6/552

(56) References Cited

U.S. PATENT DOCUMENTS

| | | | | | |
|---|---|---|---|---|---|
| 77,452 | A | * | 5/1868 | Bruschman | 91/344 |
| 295,857 | A | * | 3/1884 | Collender | 211/15 |
| 297,031 | A | * | 4/1884 | Tea | 211/15 |
| 391,677 | A | * | 10/1888 | Becker | 211/68 |
| 815,228 | A | | 3/1906 | Stone | |
| 884,699 | A | * | 4/1908 | Yewell | 211/15 |
| 1,418,093 | A | * | 5/1922 | Parmater | 211/15 |
| 1,478,043 | A | * | 12/1923 | Matteson | 211/68 |
| 2,155,191 | A | | 4/1939 | Hylton et al. | |
| 2,212,129 | A | | 8/1940 | Rust | |
| 2,221,704 | A | | 11/1940 | Farley | |
| 2,756,914 | A | | 7/1956 | Bonderer | |
| 2,767,854 | A | | 10/1956 | Barrett | |
| 2,780,508 | A | | 2/1957 | Bonderer | |
| 3,497,118 | A | | 2/1970 | Najjar | |
| 3,750,831 | A | * | 8/1973 | Souza | 221/188 |
| 3,777,933 | A | * | 12/1973 | Joliot | 221/309 |
| 3,842,979 | A | | 10/1974 | Doelcher | |
| 3,869,137 | A | | 3/1975 | Byrom | |
| 3,908,825 | A | | 9/1975 | Ayoub et al. | |
| 4,046,284 | A | * | 9/1977 | Samuelsson | 221/45 |
| 4,082,209 | A | | 4/1978 | Sanders | |
| 4,339,120 | A | | 7/1982 | Czarny | |
| 4,678,108 | A | | 7/1987 | Inman | |
| 4,798,319 | A | | 1/1989 | James, Jr. | |
| 4,840,332 | A | | 6/1989 | Hoyt | |
| 4,955,529 | A | | 9/1990 | Barnhart | |
| 5,060,996 | A | * | 10/1991 | Garnes | 294/19.2 |
| D321,921 | S | | 11/1991 | Johnson | |
| 5,147,119 | A | | 9/1992 | Harris | |
| 5,183,154 | A | | 2/1993 | Slemp | |
| 5,184,735 | A | | 2/1993 | Black | |
| 5,191,997 | A | * | 3/1993 | Squitieri | 221/119 |
| 5,292,161 | A | * | 3/1994 | Green | 294/19.2 |
| 5,339,985 | A | * | 8/1994 | Perez | 221/151 |
| 5,366,075 | A | * | 11/1994 | Mills | 206/315.6 |
| D353,180 | S | | 12/1994 | Dunning | |
| 5,472,189 | A | * | 12/1995 | Pfeiffer et al. | 221/155 |
| 5,553,707 | A | | 9/1996 | Lion | |
| D375,406 | S | | 11/1996 | Smith | |
| 5,573,122 | A | | 11/1996 | Williams | |

(List continued on next page.)

*Primary Examiner*—Daniel P. Stodola
*Assistant Examiner*—Khoa Tran
(74) *Attorney, Agent, or Firm*—Price, Heneveld, Cooper, DeWitt & Litton

(57) ABSTRACT

A rack for storing billiard balls including a base having a first engagement surface. The rack also includes an elongated billiard ball holder defining an elongated central space configured to support a plurality of billiard balls in contact with one another in a row. The billiard ball holder includes an opening to the elongated central space such that billiard balls can be inserted into the central space through the opening. The billiard ball can be tilted to roll the stored billiard balls through the opening. The billiard ball holder has a second engagement surface configured to removably engage the first engagement surface of the base and retain the billiard ball holder in a generally upright position wherein the elongated central space extends generally vertically. The billiard ball holder is removable from the base to facilitate transport of the billiard ball holder and stored balls to an associated billiards table.

6 Claims, 5 Drawing Sheets

U.S. PATENT DOCUMENTS 5,664,672 A 9/1997 Niksich
5,722,543 A * 3/1998 Jarmuzewski ..... 209/559
5,772,090 A 6/1998 Rodriquez
5,810,681 A * 9/1998 Heim ..... 473/496
6,050,625 A * 4/2000 Nisbet ..... 294/19.2
D429,936 S * 8/2000 McCormick et al. ..... D6/552
D431,951 S * 10/2000 McCormick ..... D6/552
D431,952 S * 10/2000 McCormick ..... D6/552
D436,778 S * 1/2001 McCormick ..... D6/552
D436,779 S * 1/2001 McCormick ..... D6/552

* cited by examiner

BILLIARD BALL RACK

BACKGROUND OF THE INVENTION

The present invention relates to a billiard ball rack, and in particular to a billiard ball rack that can be used to store and transport billiard balls.

Billiard balls are commonly stored and/or transported utilizing a plastic billiard ball tray having a plurality of generally hemispherical indentations, each of which receives and supports a billiard ball. The game of eight ball utilizes a total of sixteen billiard balls, such that billiard ball trays designed to support such a set of billiard balls generally include a total of 16 indentations arranged in a square pattern formed by four rows of indentations, each row including four such indentations. However, ball trays may include more indentations if required. For example, a standard set of snooker balls includes a total of twenty-two balls, such that a snooker ball tray would include twenty-two indentations. However, a smaller number of snooker balls may be utilized for smaller than full-sized snooker tables. For example, a standard set of snooker balls includes fifteen red balls. However, ten red balls may be utilized for smaller than full-sized tables rather than the standard fifteen red balls.

Although known billiard ball trays are generally functional for holding and transporting billiard balls, existing billiard ball trays support the billiard balls in a flat, generally planar configuration such that the tray has relatively large horizontal dimensions. Accordingly, existing billiard ball trays take up shelf space or the like, and are also generally not aesthetically pleasing. Furthermore, if the billiard ball tray is inadvertently knocked from a shelf or other such storage location, the billiard balls will generally roll around upon impact with the floor surface, thus requiring the user to retrieve the balls from about the room.

Accordingly, a billiard ball holder relieving the above-identified shortcomings is desired.

SUMMARY OF THE INVENTION

One aspect of the present invention is to provide a rack for storing billiard balls. The rack includes a base having a first engagement surface. The rack also includes an elongated billiard ball holder defining an elongated central space configured to support a plurality of billiard balls in contact with one another in a row. The billiard ball holder includes an opening to the elongated central space such that billiard balls can be inserted into the central space through the opening. The billiard ball can be tilted to roll the stored billiard balls through the opening. The billiard ball holder has a second engagement surface configured to removably engage the first engagement surface of the base and retain the billiard ball holder in a generally upright position wherein the elongated central space extends generally vertically. The billiard ball holder is removable from the base to facilitate transport of the billiard ball holder and stored balls to an associated billiards table.

Another aspect of the present invention is a rack for storing billiard balls and pool cues. The rack includes a base including at least one holder configured to support a pool cue. The base also includes an upwardly opening aperture. The rack includes an elongated billiard ball holder defining a lower end and an elongated cylindrical cavity having sufficient size to receive at least fifteen billiard balls. The cavity has at least one opening of sufficient size to permit billiard balls to pass therethrough. The aperture and the billiard ball holder are configured such that the lower end of the billiard ball holder can be removably received in the aperture to retain the billiard ball holder in an upright position.

Yet another aspect of the present invention is a rack for storing billiard balls including a billiard ball holder configured to retain a plurality of billiard balls. The billiard ball holder defines an upper end and a lower end. The rack also includes a base having a lower portion including an upwardly opening lower aperture with a support positioned in the lower aperture. The base has an upper portion including a downwardly opening upper aperture located above the lower aperture and defining a vertical distance between the upper and lower apertures. The billiard ball holder has a length between the upper and lower ends that is greater than the vertical distance, such that the billiard ball holder can be installed to the base by inserting the upper end into the upper aperture, followed by rotation of the lower end into alignment with the lower aperture. The billiard ball holder is then shifted downwardly onto the support, and the support positions the billiard ball holder with the upper end at least partially within the upper aperture such that the billiard ball holder is retained in an upright position.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
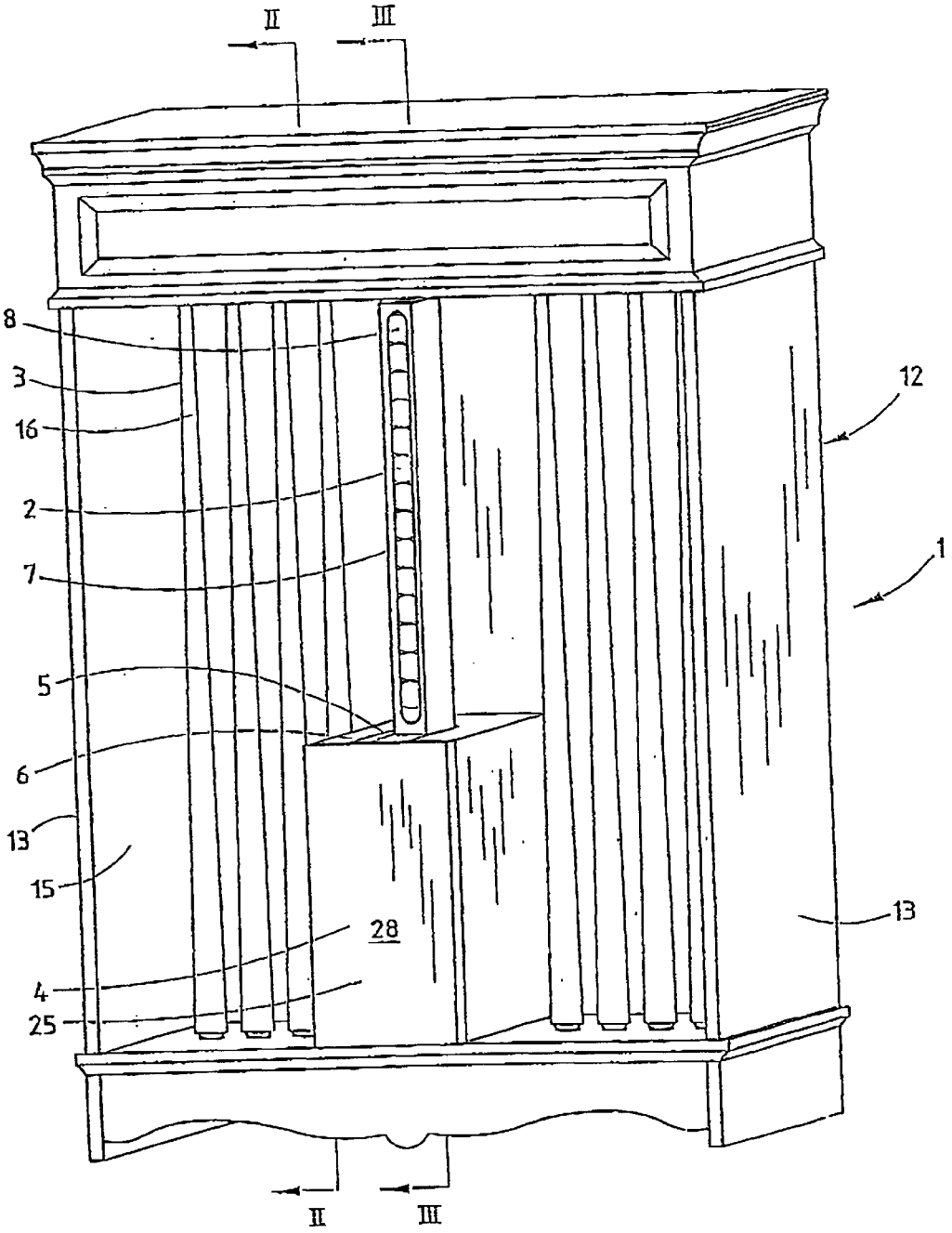
FIG. 1 is a perspective view of the rack for storing billiard balls and pool cues of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a rack for storing billiard balls 2, and billiard cues 3. In the illustrated example, the rack 1 includes a base 4 having a first engagement surface 5 formed by a shallow slot 6. The rack 1 also includes an elongated billiard ball holder 7 defining an elongated central space 8 configured to support a plurality of billiard balls 2 in contact with one another in a row. The billiard ball holder 7 includes an opening 9 (see also FIG. 4) to the elongated central space 8, such that billiard balls 2 can be inserted into the central space 8 through the opening 9. The billiard ball holder 7 can also be tilted to roll the stored billiard balls through the opening 9 onto an associated billiards table.

The billiard ball holder 7 has a second engagement surface 10 at the lower end 11 of the 10 billiard ball holder 7. The second engagement surface 10 is configured to removably engage the first engagement surface 5 and retain the billiard ball holder 7 in a generally upright position wherein the elongated central space 8 extends generally vertically. The billiard ball holder 7 is removable from the base 4 to facilitate transport of the billiard ball holder 7 and stored billiard balls 2 to an associated billiards table.

The present invention is related to U.S. Design Pat. No. D 431,952, entitled BILLIARD BALL HOLDER; U.S. Design Pat. No. D 436,779, entitled BILLIARD BALL HOLDER; U.S. Design Pat. No. D 436,778, entitled BILLIARD BALL HOLDER; U.S. Design Pat. No. D 431,951, entitled BILLIARD BALL HOLDER; U.S. Design Pat. No. D 429,937, entitled ACCESSORY CABINET FOR A BILLIARD CUE RACK; and U.S. Design Pat. No. D 429,936, entitled BILLIARD CUE CABINET, the entire contents of each of which are hereby incorporated herein by reference.

The rack 1 of FIG. 1 includes an upright cabinet 12 having spaced-apart side walls 13, and a rear wall 14 forming an open space 15 that receives a plurality of billiard cues 16, and the billiard ball holder 7. An upper horizontal wall member 17 (FIG. 2) includes a plurality of openings 20 that receive the upper end portion 21 of the billiard cues 16. The lower or butt end 22 of the cues 16 are received in shallow depressions 23 in lower horizontal wall 18. The openings 20 in upper horizontal wall 17 are illustrated as being generally circular holes. However, it is anticipated that openings 20 could comprise a U-shaped slot that opens at the side edge 24 of the wall 17, in a manner similar to the opening or slots 63 described in more detail below in connection with the embodiment of the rack illustrated in FIG. 9. The cues 16 are stored by inserting the upper ends 21 through the openings 20, followed by rotation of the cues 16 to a position wherein the lower end 22 of the cues 16 is directly above the associated depression 23. The cue 16 is then shifted downwardly until the lower end 22 of the cue 16 abuts depression 23.

Figure 2:
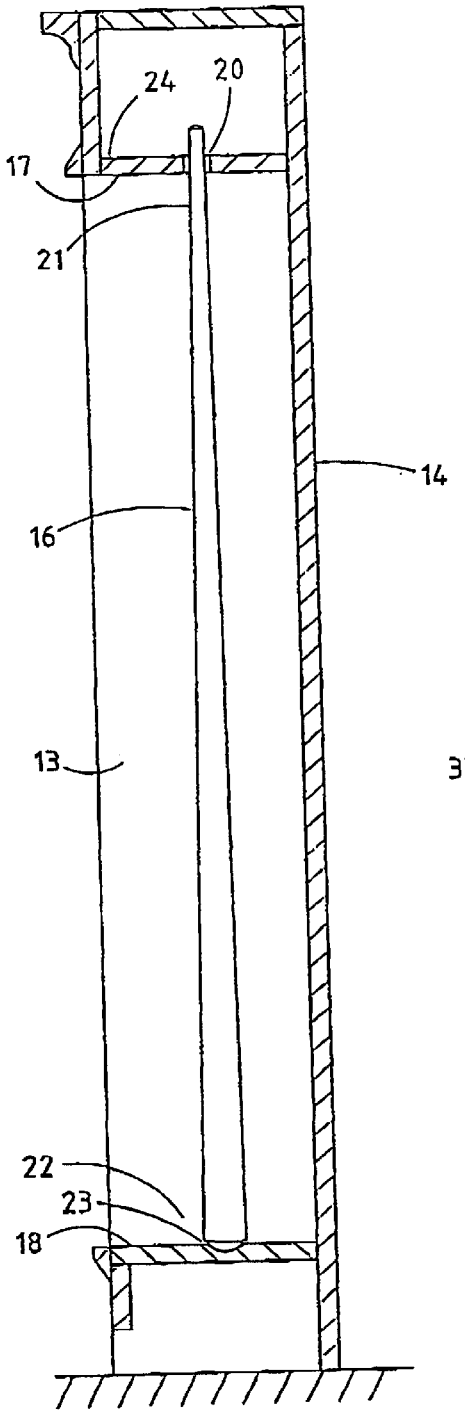
FIG. 2 is a cross-sectional view of the rack of FIG. 1 taken along the line II—II.
Figure 3:
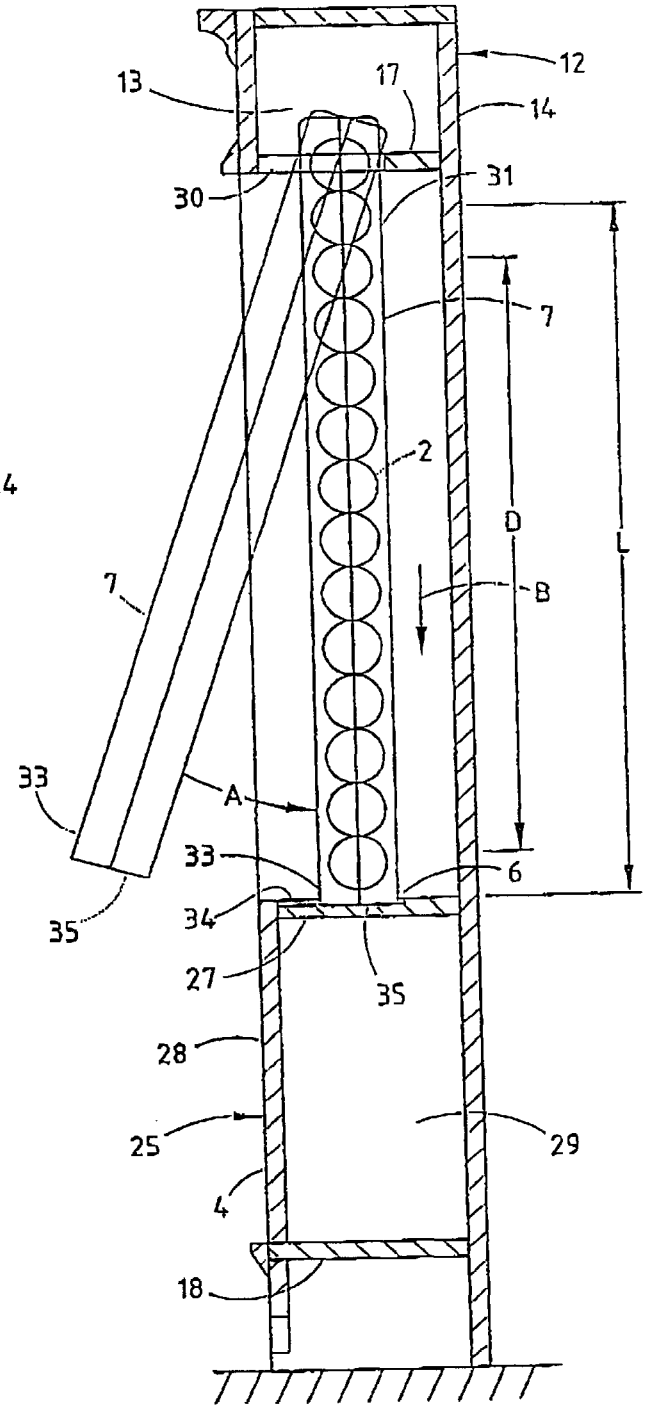
FIG. 3 is a cross-sectional view of the rack of FIG. 1 taken along the line III—III.

As illustrated in FIGS. 1–3, the base 4 of cabinet 12 includes a box-like structure 25 having an upper wall 27. A front wall 28 closes off the box-like structure 25, and may be hingedly mounted to form a door to provide access to the open interior space 29 of box-like structure 25. Horizontal wall 17 includes an elongated opening 30 that receives an upper, open end 31 of billiard ball holder 7, and wall 27 of box structure 25 includes shallow slot 6 that receives and retains a lower end 33 of billiard ball holder 7. The billiard ball holder 7 has an overall length "L" that is greater than the distance "D" between the horizontal walls 17 and 27. Billiard ball holder 7 is installed in the cabinet 12 by inserting the upper end 31 of billiard ball holder 7 into opening 30. The lower end 33 of billiard ball holder 7 is then rotated inwardly in the direction of the arrow "A" until the lower end 33 of billiard ball holder 7 is directly above the slot 6 in horizontal wall 27. The billiard ball holder 7 is then shifted downwardly in the direction of the arrow "B", until the end surface 35 of the billiard ball holder 7 abuts the upper surface 34 of slot 6. The billiard ball holder 7 may be removed from the cabinet 12 by shifting the billiard ball holder 7 upwardly in the direction opposite the arrow "B", followed by rotation of the lower end 33 of billiard ball holder 7 outwardly, opposite the arrow "A". The billiard ball holder 7 is then shifted downwardly and outwardly out of the opening 30.

Figure 4:
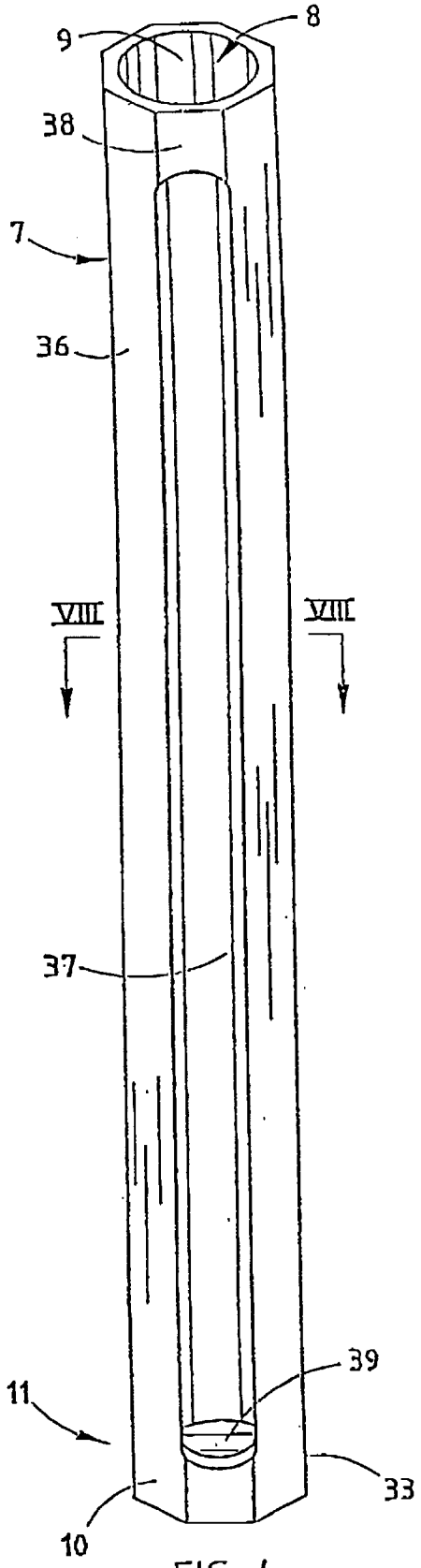
FIG. 4 is a perspective view of the billiard ball holder of FIG. 1.
Figure 5:
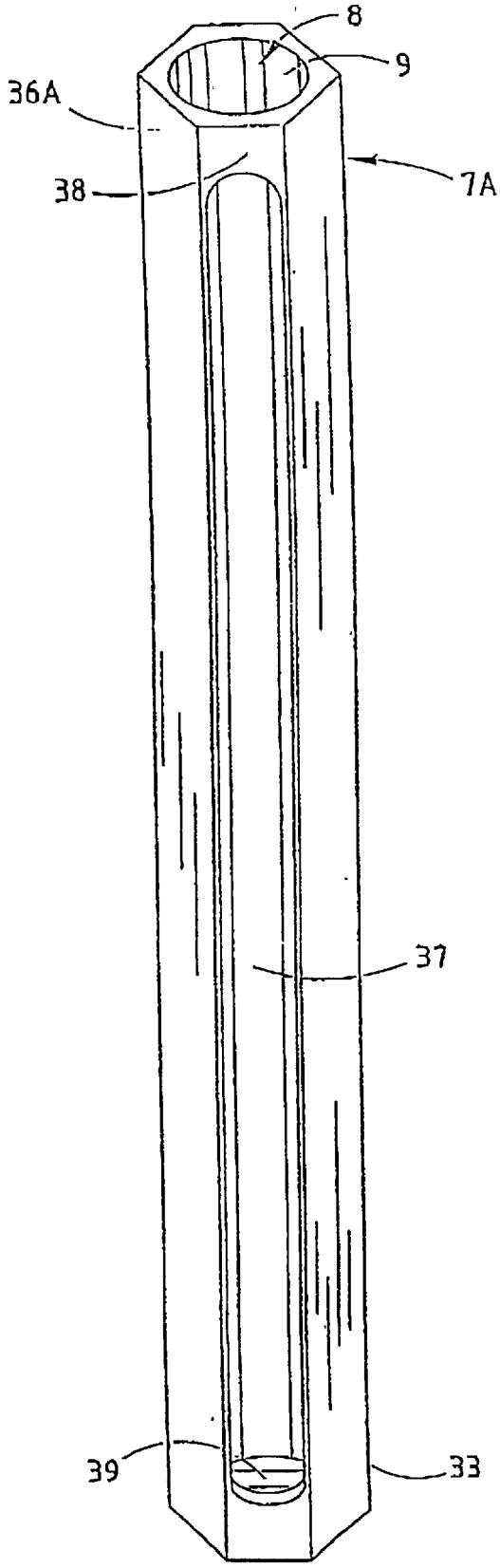
FIG. 5 is a perspective view of a second embodiment of the billiard ball holder, wherein the billiard ball holder includes six outer side faces.
Figure 6:
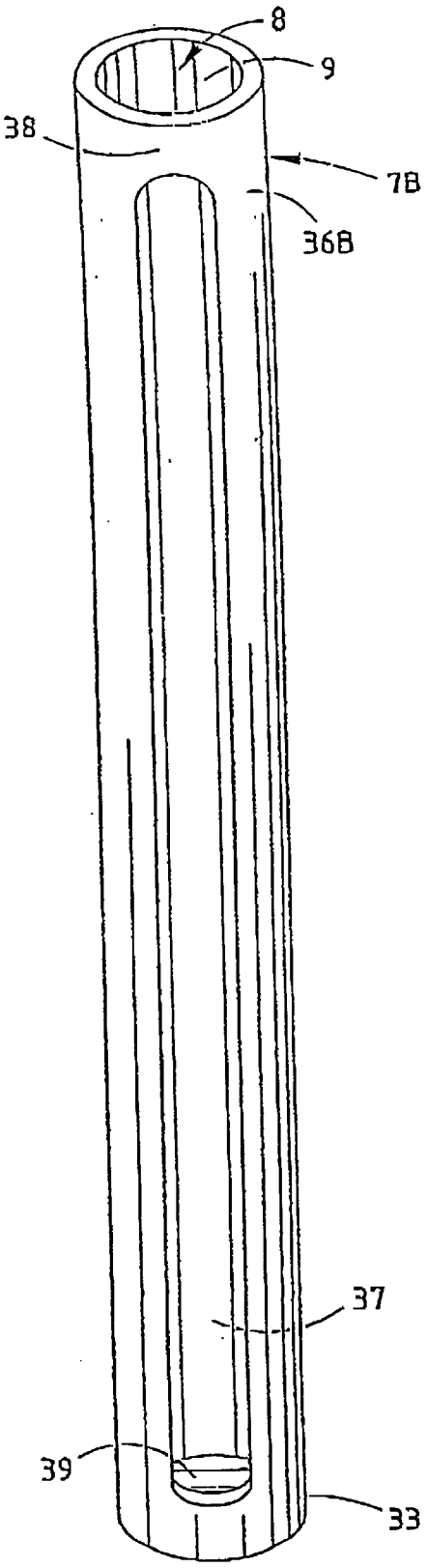
FIG. 6 is a perspective view of a third embodiment of the billiard ball holder, wherein the outer surface is generally cylindrical.
Figure 7:
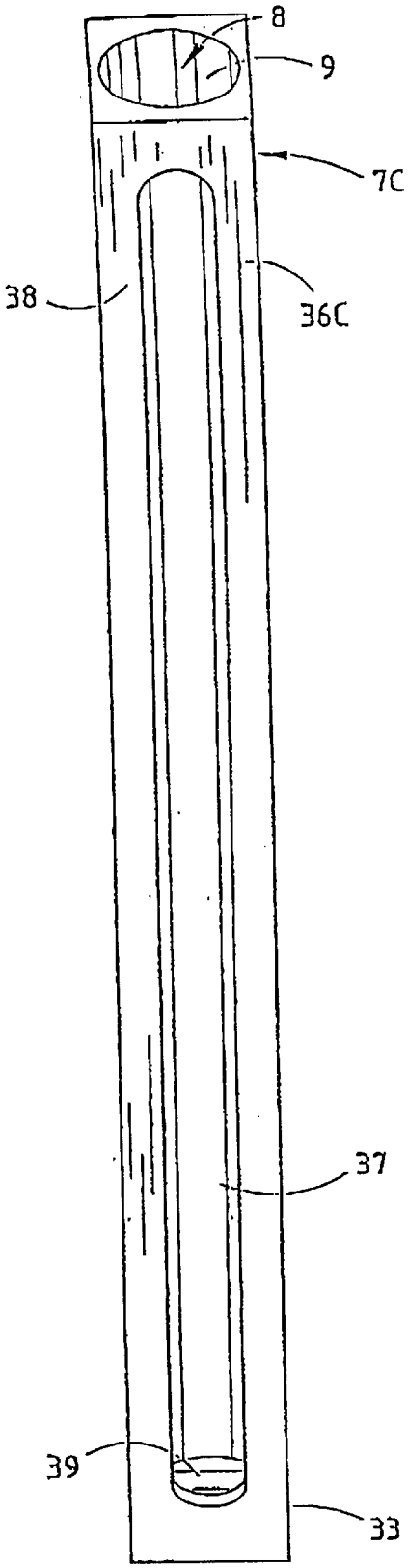
FIG. 7 is a perspective view of a fourth embodiment of the billiard ball holder, wherein the billiard ball holder includes four outer side faces.

With further reference to FIGS. 4–7, billiard ball holder 7 may include eight outer side faces 36 (FIG. 4). In a second embodiment (FIG. 5), billiard ball holder 7A includes six outer side faces 36A. In a third embodiment (FIG. 6), the billiard ball holder 7B has a cylindrical outer surface 36B. In a fourth embodiment, the billiard ball holder 7C includes four outer side faces 36C. Each of the billiard ball holders 7, 7A, 7B, and 7C include an elongated central space 8 having a generally cylindrical shape. The central space 8 has a diameter sufficient to receive the billiard balls for a particular billiard table. For example, a standard pocket billiard ball has a diameter of 2 ¼ inches 0.005 inches. A standard snooker ball has a diameter of 2 1/16 inches. However, smaller snooker balls may be manufactured for smaller than floor-size tables, with diameters of 1 ⅞, 1 ¾, and 1 ⅝ inches, for example. The diameter of the central space 8 is slightly larger than the diameter of the particular billiard ball being stored, such that the billiard balls 2 can easily roll within the central space 8 when inserted or removed through the opening 9. Each of the billiard ball holders 7, 7A, 7B, and 7C include an elongated slot 37 through side wall 38, such that a user can readily determine if billiard balls 2 are disposed within the central space 8 of the billiard ball holder 7.

Figure 8:
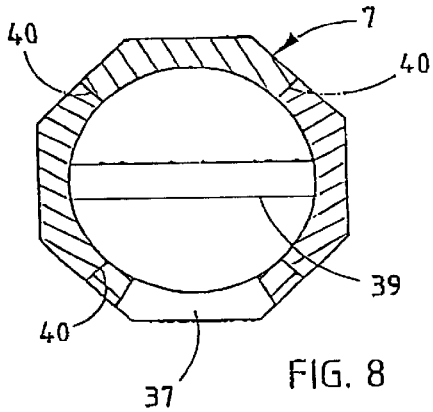
FIG. 8 is a cross-sectional view of the billiard ball holder of FIG. 4 taken along the line VIII—VIII.
Figure 10:
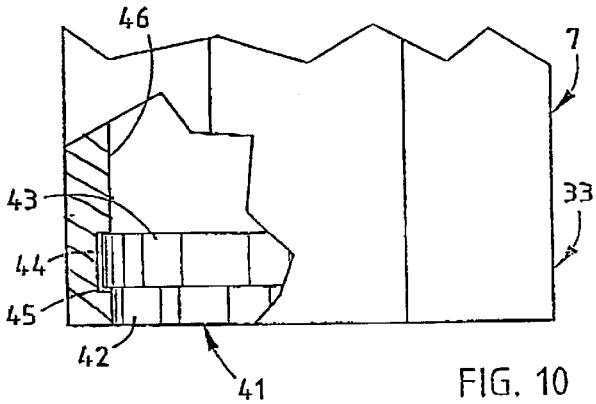
FIG. 10 is a fragmentary view of a lower end portion of a billiard ball holder incorporating a stop member having a disk like shape.

Each of the billiard ball holders 7, 7A, 7B, and 7C include a pin 39 (see also FIG. 8) disposed within the central space 8 at the lower end 33 of the billiard ball holder. The pin 39 provides a stop, such that the billiard balls 2 are supported and retained within the central space 8 of the billiard ball holder 7 when the billiard ball holder 7 is in the upright position. As illustrated in FIG. 10, a disk like member 41 may be utilized to close off the lower end 33 of the billiard ball holder 7, and provide a stop to retain the billiard balls within the billiard ball holder 7. Disk 41 includes a first portion 42 having an outer diameter that is substantially the same as the inner diameter of the elongated central space 8 of the billiard ball holder 7. In a second portion 43 of the disk 41 has an outer diameter that is larger than that of the central space 8, and the outer edge portion 44 of the second disk portion 43 fits snuggly within an annular groove 45 that extends around the inner surface 46 of billiard ball holder 7. In a preferred embodiment, the billiard ball holders 7 and cabinet 12 are fabricated from wood. The billiard ball holders 7 may be fabricated from two or more elongated pieces, and joined at elongated joints 40 running the length of the billiard ball holder 7. Joints 40 may be glued tongue and groove joints. Alternately, a pair of opposed grooves may be formed, and an elongated spline may be fitted into the grooves and glued. Other known woodworking joints may also be utilized.

Figure 9:
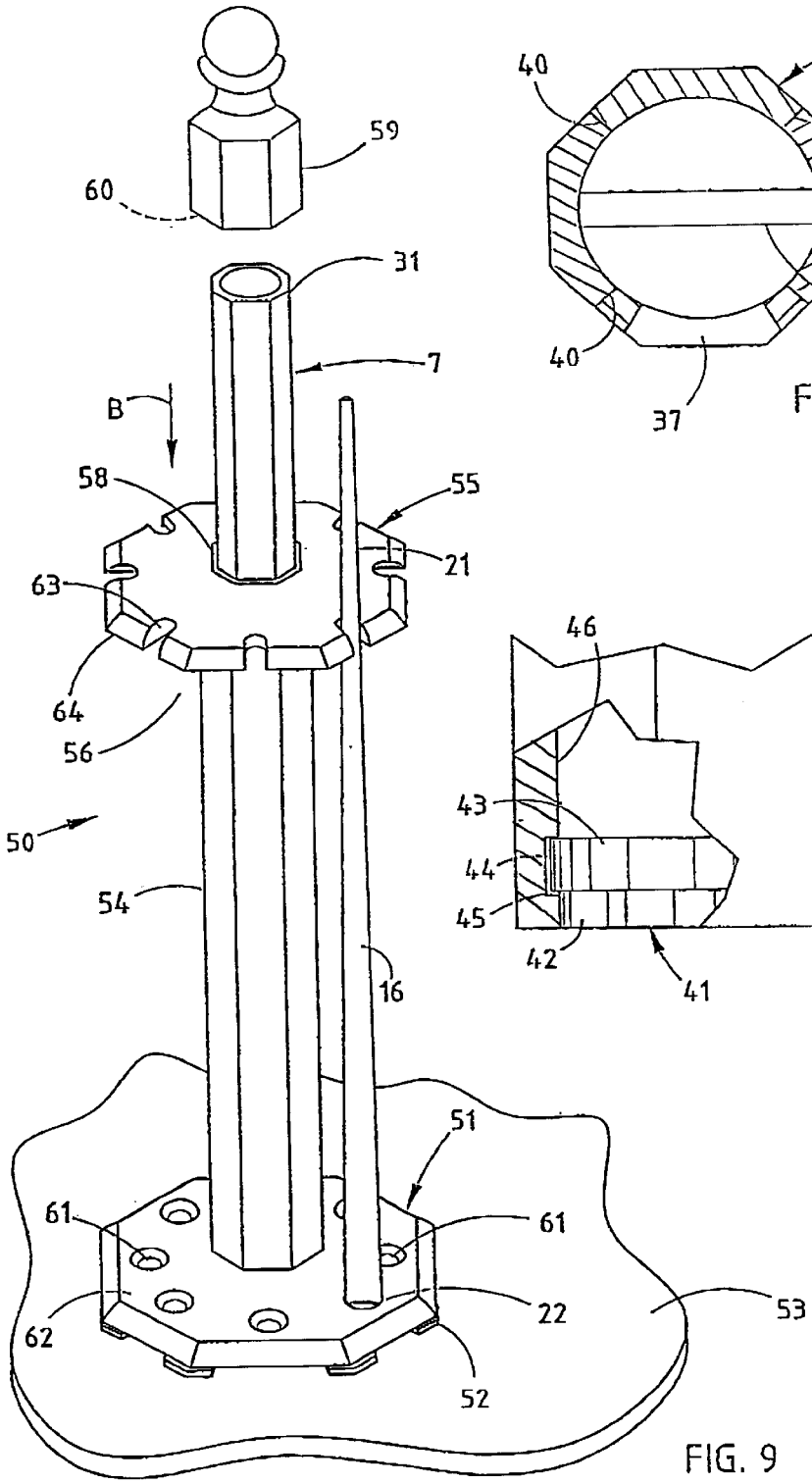
FIG. 9 is a perspective view of a second embodiment of a rack for storing billiard balls and pool cues, wherein the billiard ball holder is received within an upwardly extending tube-like member, and the pool cues are positioned at equal angular positions about the axis of the billiard ball holder.

With reference to FIG. 9, a second embodiment 50 of the rack of the present invention includes a generally flat, octagonal base plate 51 including a plurality of feet 52 configured to abutingly support the rack 50 upright on a floor surface 53. An elongated tube-like member 54 is secured to the base or plate 51, and extends upwardly therefrom. An upper octagonal plate-like member 55 is secured to the upper end 56 of the upright tube structure 54. The tube structure 54 includes an elongated internal cavity 58 having a sidewall shape closely corresponding to the outer surface of the billiard ball holder 7. Thus, the tube structure 54 may have an internal cavity 58 with an inner wall surface having a shape conforming to that of the outer wall surfaces of the embodiments of the billiard ball holders illustrated in FIGS. 4–7. The internal cavity 58 has a dimension greater than the outer surfaces of billiard ball holder 7, such that holder 7 can be telescopically, slidably received in cavity 58. A cap 59 includes an internal cavity 60 having a cross-sectional shape substantially the same as the tube structure 54, and the cap 59 fits over and around the upper end 31 of the billiard ball holder 7 when installed.

A plurality of openings or depressions 61 in plate 51 receive the lower ends 22 of billiard cues 16. Upper plate member 55 includes a plurality of outwardly-opening slots 63 that receive and retain the upper end portions 21 of cues 16. Slots 63 open at the edge 64 of upper plate 55. However, circular apertures through the plate 55 may also be utilized instead of the slots 63.

The billiard ball holder 7 is installed in the tube structure 54 by positioning the lower end 33 of billiard ball holder 7 in the cavity 58. The billiard ball holder 7 is then shifted downwardly in the direction of the arrow "B" until the end surface 35 of billiard ball holder 7 abuts the upper surface 62 of lower plate member 51. The cap 59 is then installed over the upper end 31 of billiard ball holder 7. The billiard ball holder 7 may be removed by removing cap 59, followed by shifting of the billiard ball holder 7 upwardly out of the tube structure 54.

The rack 1 of the present invention provides a convenient way to store and transport billiard balls 2. The billiard balls 2 are stored in an upright position, thus reducing the floor space required. Further, the billiard balls 2 can be easily transported from the stored position to a billiard table by a user. The billiard balls 2 are deposited on the surface of the billiard table by simply tilting the billiard ball holder 7 to a position wherein the lower end 33 is positioned above the upper end 31. The billiard balls 2 will then roll out of the opening 9. For storage of the billiard balls 2, the billiard balls 2 are inserted into the opening 9 of the elongated central space 8 of the billiard ball holder 7. The billiard ball holder 7 is then transported to the cabinets 12 and installed therein as described above.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A rack for storing billiard balls, comprising:

a billiard ball holder having a cavity configured to retain a plurality of billiard balls, said billiard ball holder defining an upper end and a lower end, and having an opening adjacent said upper end to permit billiard balls to exit said cavity, said lower end having an immovable stop to prevent exit of billiard balls from said lower end;

a support including a base having a lower engagement surface, said support having an upper portion including an upper aperture above said lower engagement surface and defining a vertical distance between said upper aperture and said lower engagement surface; and said billiard ball holder having a length between said upper and lower ends that is greater than said vertical distance, such that said billiard ball holder can be installed to said support by inserting said upper end into said upper aperture, rotating said lower end into alignment with said lower engagement surface, and shifting said billiard ball holder downwardly onto said engagement surface, thereby positioning said billiard ball holder with said upper end at least partially within said upper aperture such that said billiard ball holder is retained in an upright position.

2. The rack for storing billiard balls set forth in claim 1, wherein:

said billiard ball holder has an elongated tubular construction defining an elongated central space configured to receive a plurality of billiard balls.

3. The rack for storing billiard balls set forth in claim 2, wherein:

said elongated central space is generally cylindrical with a diameter of at least about two and one-quarter inches.

4. The rack for storing billiard balls set forth in claim 3, wherein:

said billiard ball holder includes an elongated opening providing visual access to said elongated central space such that a user can determine whether or not billiard balls are present in said billiard ball holder.

5. The rack for storing billiard balls set forth in claim 4, wherein:

said support includes an upright member extending upwardly from said lower portion; said support including an upper portion secured to said upright member adjacent an upper end thereof;

said lower portion having at least one lower opening configured to receive a first end of a billiard cue; and said upper portion including at least one opening in registry with said lower opening to receive and retain a tip portion of a billiard cue and support the billiard cue in a generally upright position.

6. The rack for storing billiard balls set forth in claim 5, wherein:

said support comprises a cabinet;

said upright member forming a vertical rear wall of said cabinet;

said lower portion including a plurality of lower depressions configured to receive a billiard cue and positioned adjacent a front portion of said lower portion in front of said vertical rear wall; and said upper portion including a plurality of openings, each in vertical registry with a selected one of said lower depressions and configured to receive a tip portion of a billiard cue to retain the billiard cue in a generally upright position.

* * * * *